United States Patent [19]

Schmitz

[11] 4,082,478

[45] Apr. 4, 1978

[54] VACUUM CLEANER FAN

[75] Inventor: Joseph Francis Schmitz, St. Paul, Minn.

[73] Assignee: Whirlpool Corporation, Benton Harbor, Mich.

[21] Appl. No.: 702,284

[22] Filed: Jul. 2, 1976

[51] Int. Cl.[2] ..... F01D 9/00

[52] U.S. Cl. ..... 415/209; 415/206; 415/219 C; 417/423 A

[58] Field of Search ..... 415/204, 206, 208, 209, 415/210, 211, 219 C, 219 A; 417/423 A, 366, 369

[56] References Cited

U.S. PATENT DOCUMENTS

| | | | |
|---|---|---|---|
| 341,218 | 5/1886 | Blakely | 415/219 C |
| 815,674 | 3/1906 | Bent | 415/219 C |
| 1,004,212 | 9/1911 | Smith | 415/206 |
| 2,114,780 | 4/1938 | Juelson | 417/423 A |
| 2,201,867 | 5/1940 | McMahan | 415/219 C |
| 2,330,938 | 10/1943 | Williams | 415/219 C |
| 2,439,124 | 4/1948 | Bergstrom | 415/219 A |
| 3,147,909 | 9/1964 | Novitsky | 415/219 C |
| 3,425,621 | 2/1969 | Greenheck | 417/360 |
| 3,469,519 | 9/1969 | Painter | 415/219 C |
| 3,687,568 | 8/1972 | Looker | 415/99 |
| 3,759,627 | 9/1973 | Ehlinger | 415/178 |
| 3,791,772 | 2/1974 | Keimpema | 417/423 A |
| 3,829,250 | 8/1974 | Samson, Jr. | 417/423 |
| 3,945,771 | 3/1976 | Arakawa | 415/219 C |

FOREIGN PATENT DOCUMENTS

| | | | |
|---|---|---|---|
| 1,428,214 | 7/1969 | Germany | 415/211 |
| 644,260 | 10/1950 | United Kingdom | 417/423 A |

*Primary Examiner*—C. J. Husar

*Attorney, Agent, or Firm*—Wegner, Stellman, McCord, Wiles & Wood

[57] ABSTRACT

A vacuum cleaner apparatus having a fan housing defining a plurality of corner portions and a wall structure extending across the housing and defining with the housing corner portions flow restricting air flow passages for conducting air from the fan impeller through a discharge portion of the housing with improved efficiency. The housing may be polygonal in transverse cross section and the wall structure may have turned edge portions for suitably cooperating with the housing in directing the air from the fan through the air flow passages.

16 Claims, 13 Drawing Figures

Fig. 1.
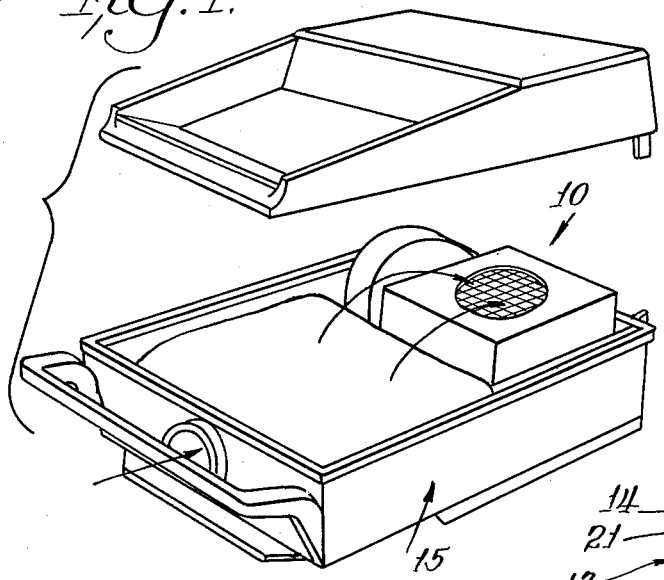
Fig. 2.
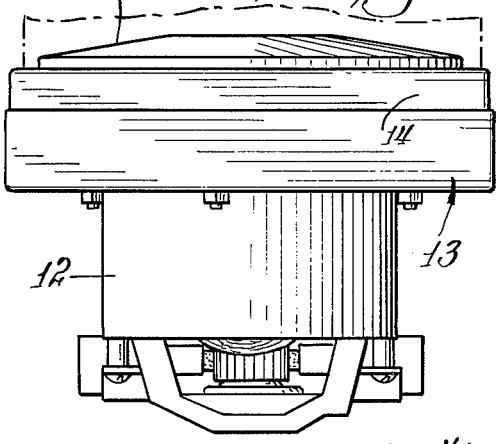
Fig. 12.
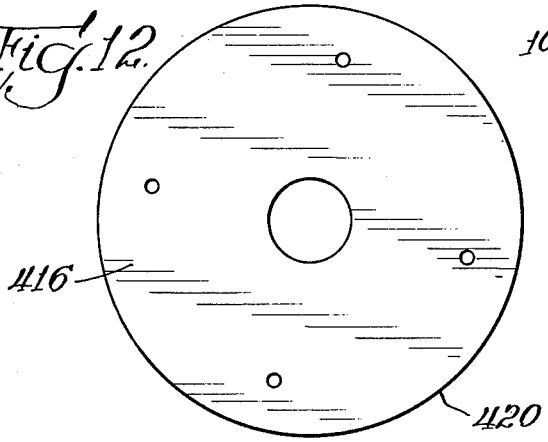
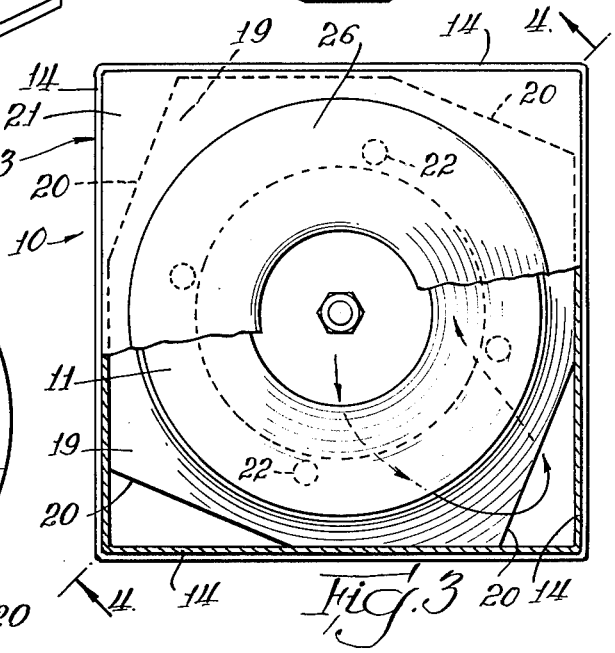
Fig. 3
Fig. 13.
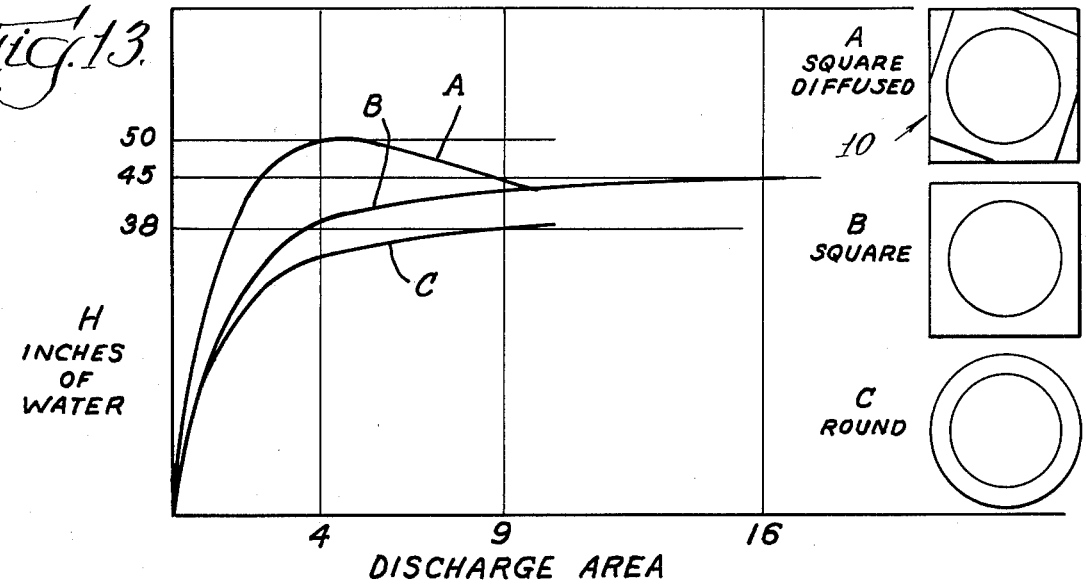

VACUUM CLEANER FAN

BACKGROUND OF THE INVENTION

1. Field of the Invention

This invention relates to an air moving apparatus and in particular to a vacuum cleaner air moving apparatus.

2. Description of the Prior Art

In the conventional vacuum cleaner, an air moving means, such as a fan, is provided within a housing for sucking dirt-laden air from the surface to be cleaned into a dirt-collecting means, such as a collecting bag. It is desirable in such vacuum cleaners to provide high efficiency in the air moving operation so as to provide a suitably powerful suction while yet minimizing the weight, size and cost of the vacuum cleaner.

One conventional air moving means for use in such vacuum cleaners comprises a two-stage fan. While such fans provide improved air moving performance, the are relatively costly.

It is further desirable in such vacuum cleaners to provide a polyhedral housing, such as one having a generally rectangular cross section. On the other hand, the conventional fan has a generally cylindrical configuration and, thus, it has been common to provide a cylindrical housing notwithstanding the general desirability of utilization of a polyhedral housing.

To convert the velocity energy of air delivered by the air moving means into a suction pressure, it has been conventional to utilize diaphragms and the like rearwardly of the air moving means. An example of such a diaphragm is disclosed in U.S. Pat. No. 1,868,659 of Axel O. Engberg et al. The diaphragm therein is bent backwards at an angle of less than 90° with the motor shaft and carries curved guide vanes. The guide vanes catch the air, which is provided with a rotary motion by the air moving means, and redirects the air in an axial direction parallel to the axis of the casing.

Charles H. Sparklin, in U.S. Pat. No. 2,438,133, owned by the assignee hereof, shows a split cylindrical housing for suction cleaners which is generally oval in transverse cross section and houses a two-stage fan, each portion of which is provided with curved blades directing the air outwardly towards the walls of the housing.

In U.S. Pat. No. 2,726,033 of Robert E. Sheahan, a fan and motor unit assembly is disclosed having a two-stage vacuum cleaner fan.

Ralph D. J. Griffiths, in U.S. Pat. No. 3,246,359, shows a compact vacuum cleaner with storage means having a rectangular cross section housing which, in turn, defines a plurality of different forms of fan housings.

In U.S. Pat. No. 3,334,370 Wilton E. Boyd discloses a lightweight portable vacuum cleaner having a single stage fan mounted in a generally cylindrical housing.

Robert C. Greenheck, in U.S. Pat. No. 3,425,621, shows an inline centrifugal fan with door wherein the fan is mounted within a relatively large outer parallelepiped housing.

U.S. Pat. No. 3,687,568 of Olin L. Looker; U.S. Pat. No. 3,759,627 of Arnold H. Ehlinger, and U.S. Pat. No. 3,829,250 of Wilfred J. Samson, Jr. are similar to Greenheck in teaching the use of generally parallelepiped outer housings in which the air moving fan is installed.

U.S. Pat. No. 3,791,772 of Keimpe K. Keimpema et al discloses a vacuum cleaner fan assembly comprising a two-stage fan having a diffuser housing defining a ring of guide blades forming a radial diffuser for bypassing air in an axial direction.

As illustrated in FIG. 13 of the drawing herein, where a cylindrical fan impeller is mounted in a square housing, a predetermined air moving performance is obtained as illustrated in curve B. Where such a cylindrical fan impeller is mounted in a cylindrical housing, a somewhat lower air moving performance is obtained, as illustrated by curve C.

SUMMARY OF THE INVENTION

The present invention comprehends an improved air moving apparatus wherein a generally cylindrical fan impeller may be mounted in a housing of polygonal cross section in combination with an improved baffle wall to provide a substantially improved air moving performance, as shown by Curve A of FIG. 13.

More specifically, the present invention comprehends the provision of such a baffle wall which cooperates with the housing in defining a plurality of air flow passages at the corners of the housing. It has been found that such an air moving apparatus provides effectively maximum air handling efficiencey with minimum housing length and transverse dimension. The resultant improved vacuum cleaner performance is obtained while maintaining effectively minimum size of the apparatus.

More specifically, it has been found that the air moving apparatus of the present invention provides an air moving performance comparable to that provided heretofore by the relatively expensive two-stage fan structures.

The use of restricted air flow passages at the corners of the fan housing unexpectedly provides a substantial improvement in the performance of the air moving means as compared with similar air moving means mounted in cylindrical housings providing substantially the same cross-sectional passage area.

It was further unexpectedly determined that the use of the baffle means for providing restricted corner passages provides an improvement in air moving performance over the Example B structure of FIG. 13 wherein even greater cross-sectional transverse area of the discharge flow passage would be present.

Thus, the present invention comprehends an improved air moving apparatus wherein a wall means is extended across the air moving means housing at a discharge portion thereof to define with corner portions of the housing flow restricting air flow passages for conducting air from the air moving means to the discharge portion.

The air flow passages thusly formed may be triangular in cross section.

The baffle wall may further be provided with turned edge portions to cooperate with the housing in redirecting the air flow from the air moving means outwardly through the air flow passages to the discharge portion of the housing.

In one illustrated embodiment, the edge portions of the baffle wall define rectilinear distal edges and in another embodiment, the edge protions define arcuate distal edges.

The baffle wall may include a planar midportion and downturned edge portions and may comprise a unitary wall member mounted within the housing.

Thus, the air moving apparatus of the present invention is extremely simple and economical of construction while yet providing the highly desirable features discussed above.

BRIEF DESCRIPTION OF THE DRAWINGS

Other features and advantages of the invention will be apparent from the following description taken in connection with the accompanying drawing wherein:

FIG. 1 is an exploded perspective view of a vacuum cleaner having an air moving apparatus embodying the invention;

FIG. 2 is a side elevation of the air moving apparatus thereof;

FIG. 3 is a top plan view of the air moving apparatus with a portion broken away to facilitate illustration thereof;

FIG. 12 is a plan view of a flat baffle wall means; and

FIG. 13 is a graph illustrating the improved air moving performance of the apparatus of the present invention.

DESCRIPTION OF THE PREFERRED EMBODIMENTS

Figures 4, 5, 6, 7, 8, 9, 10, 11:
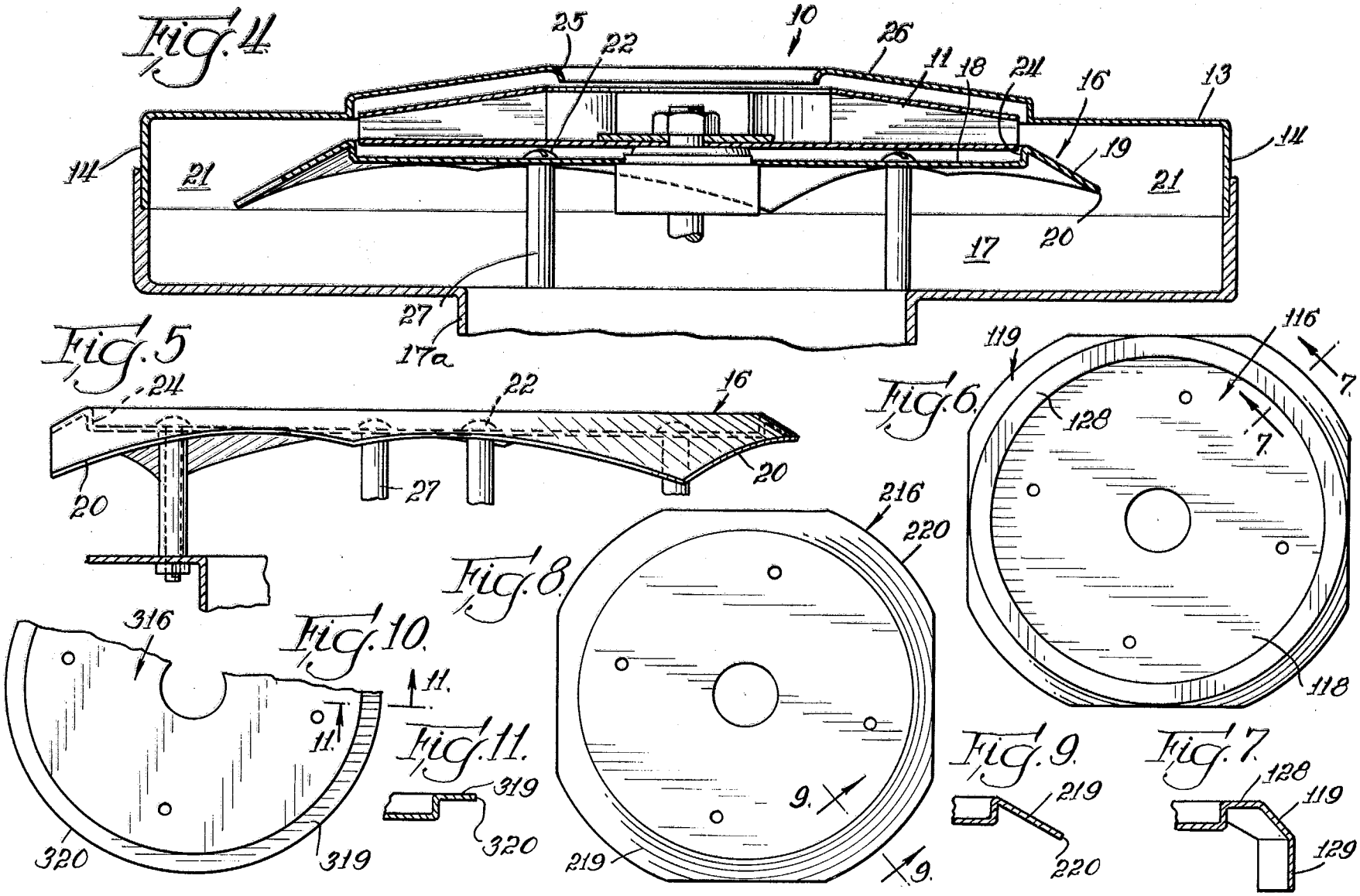
FIG. 4 is a fragmentary enlarged vertical section taken substantially along the line 4—4 of FIG. 3.
FIG. 5 is a side elevation of the baffle wall with portions of the mounting structure shown fragmentarily.
FIG. 6 is a top plan view of a modified form of baffle wall embodying the invention.
FIG. 7 is a fragmentary enlarged vertical section taken substantially along the line 7—7 of FIG. 6.
FIG. 8 is a top plan view of another modified form of baffle wall means embodying the invention.
FIG. 9 is a fragmentary enlarged vertical section taken substantially along the line 9—9 of FIG. 8.
FIG. 10 is a fragmentary top plan view of still another form of baffle wall means.
FIG. 11 is a fragmentary enlarged vertical section taken substantially along the line 11—11 of FIG. 10.

In the exemplary embodiment of the invention as disclosed in FIGS. 1–5 of the drawing, an air moving means generally designated 10 is shown to comprise a fan impeller 11 driven by a suitable electric motor 12. The air moving means is enclosed within a housing 13 which may have a polygonal cross section defining a plurality of corner portions 14. In the illustrated embodiment, the housing 13 is square in cross section and, thus, defines four corner portions 14.

As shown in FIG. 1, the air moving means may be provided in a vacuum cleaner apparatus generally designated 15 as the air moving means thereof. As indicated briefly above, while the fan impeller 11 defines a generally cylindrical configuration, and the housing defines a generally polygonal configuration, an improved air moving performance may be obtained in the air moving means 10 by the provision of a baffle wall means generally designated 16 mounted in the housing 13 downstream of the fan impeller 11 and upstream of a discharge portion 17 of the housing which defines the air outlet 17*a*.

The baffle wall means 16 may comprise a wall member having a planar midportion 18 and downturned edge portions 19. The edge portions define distal edges 20 which cooperate with the housing 13 at corner portions 14 in defining flow passages 21 providing restricted air flow from the fan impeller 11 to the discharge portion 17 of the housing. The baffle wall 16 illustrated comprises a formed sheet metal member. It is to be appreciated that the baffle wall could be formed from a solid metal member having the same surface configuration on its surface adjacent the fan impeller 11 and extending as a solid block axially away from the fan impeller to the extent of edge 20.

As seen in FIG. 3, the edges 20 of the baffle wall edge portions 19 may be substantially rectilinear so as to define with the housing corner portions 14 generally triangular cross section air flow passages 21.

The baffle wall 16 may be supported in the housing on suitable mounting posts 27 and secured therein by suitable means, such as screws 22.

The downturned edge protions 19 may comprise portions of a continuous frustoconical flange tapering downwardly from an upstanding shoulder 24 at the periphery of the planar midportion 18 of the baffle wall. As indicated in FIG. 3, the corner edges 20 may be rectilinear in plan. However, because of the frustoconical configuration, the edges are somewhat curved in elevation as shown in FIG. 5.

Thus, as illustrated in FIG. 4, fan impeller 11 may comprise a single stage fan to which air is delivered through an inlet opening 25 of an inlet wall 26 of housing 13, and from which the air is delivered radially outwardly.

The baffle wall 16 cooperates with the housing 13 to define restricted air flow passages 21 at the corners of the housing, thereby providing a substantially improved air moving performance of the apparatus 10. Thus, as shown by curve A of FIG. 13, the air moving means 10 of the present invention provides a substantially higher suction pressure for a given fan and motor as compared to the provision of such a fan and motor arrangement in a similar rectangular fan housing not utilizing the improved baffle wall means of the present invention. Further, the present invention provides improved air moving performance over a similar fan and motor structure provided in a cylindrical housing, as shown in Example C of FIG. 13.

The arrangement of FIG. 3 appears to provide optimum performance characteristics in the use of the improved baffle wall means. However, it has further been determined that modified forms of baffle wall means providing different forms of restricted corner air flow passages in such air moving means generally also provides an improved performance. Thus, as shown in FIG. 6, it has been found that a baffle wall generally designated 116 having a generally circular plan configuration also provides a substantially improved air moving performance. Thus, as shown in FIG. 6, the baffle wall means 116 may include an annular raised planar portion 128 outwardly of the central planar portion 118 thereof. The frustoconical flange portion 119 may extend downwardly from the annular portion 128, as shown in FIG. 7, to terminate in a downwardly extending segmentally cylindrical distal portion 129.

Another modified form of baffle wall means generally designated 216 is shown in FIGS. 8 and 9 to include a frustoconical peripheral portion 219 having a generally arcuate distal edge 220.

In FIGS. 10 and 11, still another modified form of baffle wall means embodying the invention is shown to comprise a baffle wall 316 wherein an annular planar flange 319 is provided defining a complete circular distal edge 320. Thus, the baffle wall means 316 differs from the previously described baffle wall means in providing peripheral flange means extending substantially perpendicular to the axis of the fan and motor rather than frustoconically relative thereto.

The invention further comprehends the provision of still another modified form of baffle wall means generally designated 416, as illustrated in FIG. 12, which comprises a flat circular wall having a continuous circular distal edge 420.

While the baffle wall means 116, 216, 316, and 416 have been found to provide somewhat less improved air moving performance as compared to the baffle wall means 16, it has been found that each of these additional embodiments also provides superior performance as compared to the prior art structures discussed above. In each of the embodiments, the baffle wall means provides a restricted air flow passage at each of the corners of the fan housing resulting in improved air moving performance and thus permitting the use of effectively minimum size and weight air moving means while yet providing effectively optimum apparatus.

The forgoing disclosure of specific embodiments is illustrative of the broad inventive concepts comprehended by the invention.

Having described the invention, the embodiments of the invention in which an exclusive property or privilege is claimed are defined as follows:

1. In an air moving apparatus having a housing defining an inlet and a discharge portion provided with corner portion and defining an outlet, and rotatable air moving means in said housing inwardly adjacent said discharge portion for moving air delivered from said inlet in a radial direction for flow longitudinally outwardly through said discharge portion outlet, the improvement comprising wall means having a midportion extending transversely across said housing at said discharge portion for preventing air flow directly longitudinally outwardly from said air moving means to said outlet and directing said air flow laterally outwardly in said housing, said wall means further defining with said housing corner portions flow restricting air flow passages for conducting the laterally directed air from said air moving means longitudinally outwardly through said passages to be discharged through said discharge portion outlet.

2. The air moving apparatus of claim 1 wherein the transverse cross section of said housing discharge portion is polygonal.

3. The air moving apparatus of claim 1 wherein the transverse cross section of said housing discharge portion is square.

4. The air moving apparatus of claim 1 wherein said air flow passages are triangular in cross section.

5. The air moving apparatus of claim 1 wherein said air moving means comprises means for directing air transversely outwardly to said air flow passages.

6. The air moving apparatus of claim 1 wherein said wall means comprises a unitary member.

7. The air moving apparatus of claim 1 wherein said wall means comprises a unitary member having turned corner portions defining with said housing said air flow passages.

8. The air moving apparatus of claim 1 wherein said wall means comprises an outwardly concave wall means.

9. The air moving apparatus of claim 1 wherein said air moving means comprises means for directing air transversely outwardly to said air flow passages, said wall means and housing cooperatively defining means for turning the air flow to pass through said air flow passages.

10. In an air moving apparatus having a housing defining an inlet and a discharge portion provided with corner portions and defining an outlet, and rotatable air moving means in said housing inwardly adjacent said discharge portion for moving air delivered from said inlet in a radial direction for flow longitudinally outwardly through said discharge portion outlet, the improvement comprising a baffle secured to said housing having a midportion extending transversely across said housing at said discharge portion for preventing air flow directly longitudinally outwardly from said air moving means to said outlet and directing said air flow laterally outwardly in said housing, said baffle further having edge portions defining with said housing corner portions flow restricting air flow passages for conducting the laterally directed air from said air moving means longitudinally outwardly through said passages to be discharged through said discharge portion outlet.

11. The air moving apparatus of claim 10 wherein said edge portions are downturned.

12. The air moving apparatus of claim 10 wherein said edge portions define rectilinear distal edges.

13. The air moving apparatus of claim 10 wherein said baffle comprises a formed sheet metal member.

14. The air moving apparatus of claim 10 wherein said housing is square in transverse cross section and said baffle is generally circular.

15. The air moving apparatus of claim 10 wherein said edge portions define arcuate distal edges.

16. The air moving apparatus of claim 10 wherein said baffle includes a planar midportion and a downturned edge portion.

* * * * *